US007205828B2

(12) United States Patent
Sridharan

(10) Patent No.: US 7,205,828 B2
(45) Date of Patent: Apr. 17, 2007

(54) VOLTAGE REGULATOR HAVING A COMPENSATED LOAD CONDUCTANCE

(75) Inventor: Srinath Sridharan, Austin, TX (US)

(73) Assignee: Silicon Laboratories, Inc., Austin, TX (US)

( * ) Notice: Subject to any disclaimer, the term of this patent is extended or adjusted under 35 U.S.C. 154(b) by 113 days.

(21) Appl. No.: 10/909,849

(22) Filed: Aug. 2, 2004

(65) Prior Publication Data

US 2006/0033555 A1 Feb. 16, 2006

(51) Int. Cl.
*G05F 1/10* (2006.01)

(52) U.S. Cl. ..... 327/540; 327/543

(58) Field of Classification Search ..... 327/538, 327/539, 540, 541, 543, 545, 546; 323/313, 323/315, 316, 280, 281

See application file for complete search history.

(56) References Cited

U.S. PATENT DOCUMENTS 5,363,059 A * 11/1994 Thiel ..... 330/253
5,410,242 A 4/1995 Bittner ..... 323/315
5,637,992 A * 6/1997 Edwards ..... 323/315
5,672,962 A * 9/1997 Sweeney ..... 323/315
5,850,139 A * 12/1998 Edwards ..... 323/280
5,867,015 A * 2/1999 Corsi et al. ..... 323/316
5,909,109 A 6/1999 Phillips ..... 323/277
6,265,856 B1 * 7/2001 Cali' et al. ..... 323/273
6,300,749 B1 * 10/2001 Castelli et al. ..... 323/273
6,304,131 B1 * 10/2001 Huggins et al. ..... 327/538
6,369,554 B1 4/2002 Aram ..... 323/282
6,392,488 B1 * 5/2002 Dupuis et al. ..... 330/277
6,420,911 B1 * 7/2002 Warmerdam et al. ..... 327/103
6,603,292 B1 * 8/2003 Schouten et al. ..... 323/277
6,690,147 B2 * 2/2004 Bonto ..... 323/280
6,700,360 B2 * 3/2004 Biagi et al. ..... 323/280
6,703,815 B2 * 3/2004 Biagi ..... 323/280
6,703,816 B2 * 3/2004 Biagi et al. ..... 323/280
6,724,176 B1 * 4/2004 Wong et al. ..... 323/316
6,894,553 B2 * 5/2005 Hulfachor et al. ..... 327/536
6,989,659 B2 * 1/2006 Menegoli et al. ..... 323/274
2003/0011350 A1 * 1/2003 Gregorius ..... 323/282
2003/0111986 A1 * 6/2003 Xi ..... 323/280
2005/0057234 A1 * 3/2005 Yang et al. ..... 323/273
2005/0189930 A1 * 9/2005 Wu et al. ..... 323/280

OTHER PUBLICATIONS

David Johns et al., "Analog Integrated Circuit Design" University of Toronto, John Wiley & Sons Inc., ISBN 0-471-14448-7, 1997. pp. 246-248.

* cited by examiner

*Primary Examiner*—Linh My Nguyen
*Assistant Examiner*—Thomas J. Hiltunen
(74) *Attorney, Agent, or Firm*—Dicke, Billig & Czaja, PLLC

(57) ABSTRACT

A voltage regulator configured to provide a regulated voltage to a load having a first conductance is provided. The voltage regulator comprises a feedback circuit configured to generate the regulated voltage and a frequency compensation circuit comprising a first MOSFET device having a second conductance. The frequency compensation circuit is configured to operate the first MOSFET device so that the second conductance varies in response to the first conductance of the load.

20 Claims, 3 Drawing Sheets

VOLTAGE REGULATOR HAVING A COMPENSATED LOAD CONDUCTANCE

BACKGROUND

Voltage regulators typically provide a regulated voltage to a load using a reference voltage. FIG. 1 illustrates a generalized voltage regulator 10 according to the prior art in which an amplifier 12, a feedback circuit 14, and a MOSFET device 16 provide a regulated voltage, $V_{reg}$, to a load 18 (represented by a load current $I_L$) using a reference voltage $V_{ref}$ and a supply voltage $V_{dd}$. More particularly, amplifier 12 provides a voltage to the gate of MOSFET device 16 in response to the reference voltage and a negative feedback voltage provided by feedback circuit 14. The voltage at the gate of MOSFET device 16 allows a relatively constant current, $I_L$, to flow from MOSFET device 16 to load 18 and generates the regulated voltage at the drain of MOSFET device 16. The regulated voltage feeds into feedback circuit 14 to generate the negative feedback voltage.

Voltage regulator 10 as shown in FIG. 1 may be designed such that the regulated voltage is relatively insensitive to process, temperature, and supply voltage variations. In addition, voltage regulator 10 may employ frequency compensation or stabilization techniques to ensure stability of the feedback system of voltage regulator 10. Many frequency compensation techniques, however, assume a relatively constant load current for voltage regulator 10. If the load current of voltage regulator 10 varies significantly, voltage regulator 10 may become unstable even where frequency compensation techniques are employed.

It would be desirable to be able to provide a voltage regulator that remains stable in response to varying load currents.

SUMMARY

According to one exemplary embodiment, a voltage regulator configured to provide a regulated voltage to a load having a first conductance is provided. The voltage regulator comprises a feedback circuit configured to generate the regulated voltage and a frequency compensation circuit comprising a first MOSFET device having a second conductance. The frequency compensation circuit is configured to operate the first MOSFET device so that the second conductance varies in response to the first conductance of the load.

In another exemplary embodiment, a method performed by a voltage regulator is provided. The method comprises providing a regulated voltage to a load having a first conductance and compensating for first variations in the first conductance of the load.

In yet another exemplary embodiment, a system comprising a functional unit having a first conductance and a voltage regulator comprising a first circuit configured to provide a regulated voltage to the functional unit and a second circuit comprising a first MOSFET device having a second conductance is provided. The second circuit is configured to operate the first MOSFET device so that the second conductance tracks the first conductance of the functional unit.

A further exemplary embodiment provides a voltage regulator for providing a regulated voltage to a load having a first conductance comprising a circuit configured to provide the regulated voltage to the load, first means for generating a second conductance, and second means for operating the first means so that the second conductance tracks the first conductance of the load.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
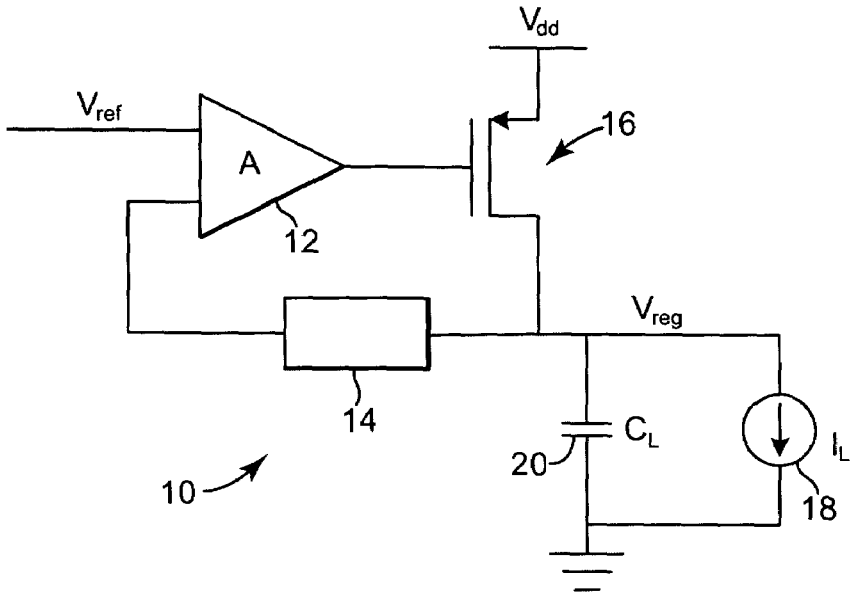
Fig. 1 (PRIOR ART)
FIG. 1 is a circuit diagram illustrating a voltage regulator according to the prior art.
Figure 2:
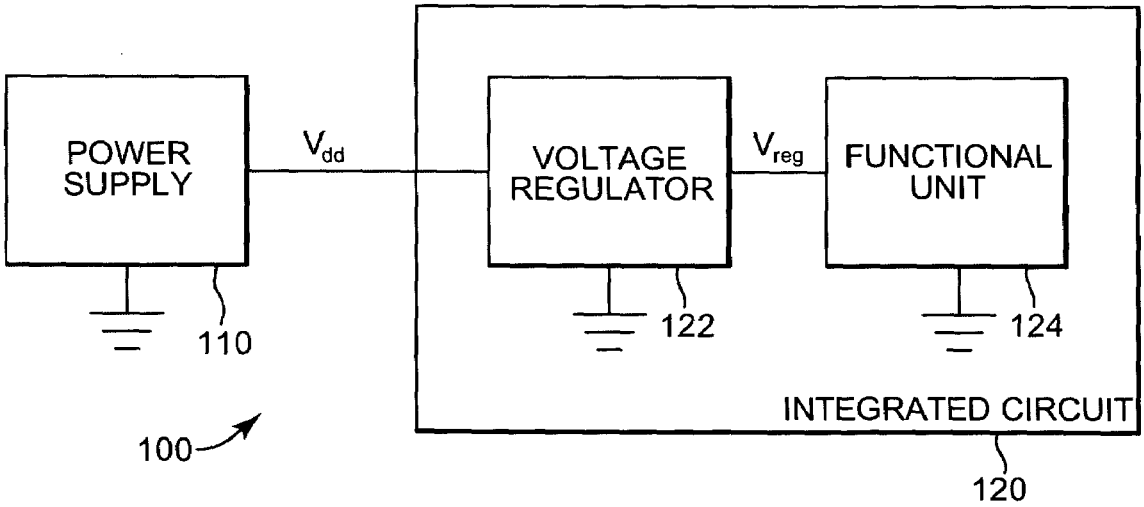
FIG. 2 is a block diagram illustrating an embodiment of a system that includes a voltage regulator.

FIG. 2 is a block diagram illustrating an embodiment of selected portions of a system 100 that includes a voltage regulator 122. System 100 comprises a power supply 110 and an integrated circuit (IC) 120 which receives a supply voltage $V_{dd}$ from power supply 110. IC 120 comprises voltage regulator 122 and a functional unit 124 which receives a regulated voltage $V_{reg}$ from voltage regulator 122.

Functional unit 124 comprises a circuit configured to perform one or more functions in system 100 using the regulated voltage provided by voltage regulator 122. Other functional units in the system (not shown) may perform the same or different functions as those performed by functional unit 124. Functional unit 124 presents a load configured to draw varying load currents from voltage regulator 122. In one embodiment, functional unit 124 may be a part of a wireless communication transceiver for use in a GSM (Global System for Mobile Communications) network. In other embodiments, functional unit 124 may be another type of transceiver or another type of electronic device configured to perform other types of functions.

Figure 3:
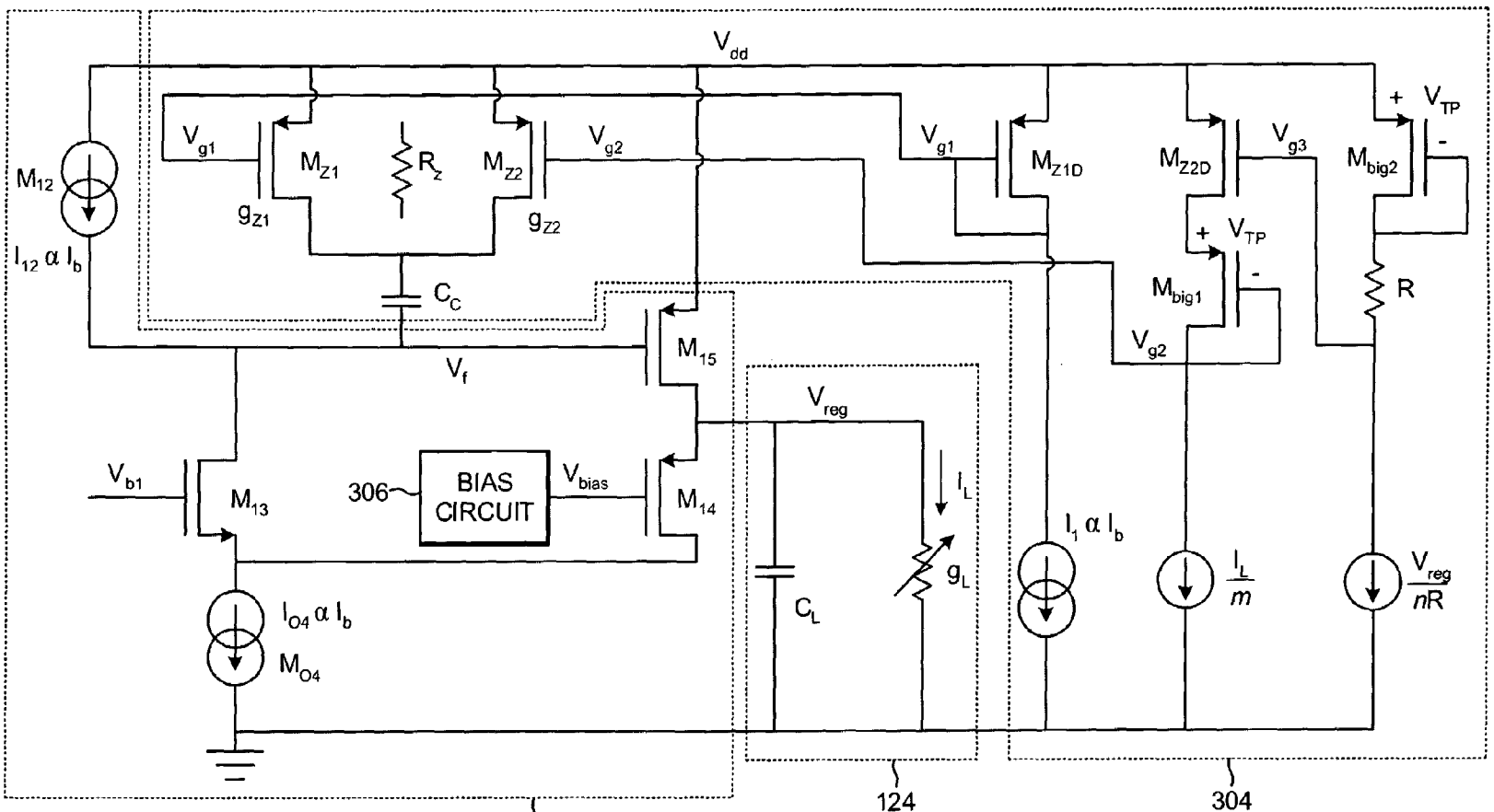
FIG. 3 is a circuit diagram illustrating an embodiment of a voltage regulator connected to a functional unit.

FIG. 3 is a circuit diagram illustrating an embodiment of voltage regulator 122 coupled to functional unit 124. In FIG. 3, voltage regulator 122 connects to the supply voltage $V_{dd}$ provided by power supply 110 to provide a regulated voltage $V_{reg}$ to functional unit 124 which is represented by a variable load conductance $g_L$ and a capacitive load element $C_L$ in FIG. 3. Voltage regulator 122 comprises a feedback circuit 302 configured to provide the regulated voltage to the load of functional unit 124 and a frequency compensation circuit 304 configured to stabilize voltage regulator 122 in response to frequency and load current variations from functional unit 124.

Feedback circuit 302 comprises a MOSFET device $M_{12}$ configured to operate as a current source $I_{12}$, an n-channel MOSFET device $M_{13}$, a p-channel MOSFET device $M_{14}$, a p-channel MOSFET device $M_{15}$, a MOSFET device $M_{O4}$ configured to operate as a current source $I_{O4}$, and a bias circuit 306.

The supply voltage is provided to MOSFET device $M_{12}$ and the source connection of MOSFET device $M_{15}$. MOSFET device $M_{12}$ connects to the gate connection of MOSFET device $M_{15}$ and the drain connection of MOSFET device $M_{13}$. The drain connection of MOSFET device $M_{15}$ connects to functional unit 124 and the source connection of MOSFET device $M_{14}$. The drain connection of MOSFET device $M_{14}$ connects to MOSFET device $M_{O4}$ and the source connection of MOSFET device $M_{13}$. MOSFET device $M_{O4}$ and the capacitive load element $C_L$ also connect to a ground node. A voltage $V_{b1}$ is provided to the gate connection of MOSFET device $M_{13}$, and a voltage $V_{bias}$ is provided to the gate connection of MOSFET device $M_{14}$.

MOSFET device $M_{15}$ provides the load current $I_L$ to functional unit 124 in response to a feedback voltage $V_f$ at the gate connection of MOSFET device $M_{15}$. MOSFET device $M_{15}$ also provides a feedback current $I_{14}$ through MOSFET device $M_{14}$ in response to a bias voltage $V_{bias}$. The bias voltage $V_{bias}$ is generated by bias circuit 306 to operate MOSFET device $M_{14}$ in a saturation region of MOSFET device $M_{14}$. Additional details of bias circuit 306 are described according to one embodiment with reference to FIG. 5 below.

MOSFET device $M_{12}$ provides a current source $I_{12}$ which flows through MOSFET devices $M_{13}$ and $M_{O4}$ to cause the feedback voltage $V_f$ to be provided to the gate connection of MOSFET device $M_{15}$. A bias voltage $V_{b1}$ is provided to MOSFET device $M_{13}$ to cause MOSFET device $M_{13}$ to be operated in a saturation region. MOSFET device $M_{O4}$ provides a current source $I_{O4}$ to draw current from MOSFET devices $M_{13}$ and $M_{14}$.

Frequency compensation circuit 304 comprises a capacitive element $C_C$, a first portion configured to compensate for the varying transconductance of MOSFET device $M_{14}$ ($g_{M14}$), and a second portion configured to compensate for the varying conductance of the load ($g_L$).

The first portion of frequency compensation circuit 304 comprises a p-channel MOSFET device $M_{Z1}$ and a biasing circuit configured to provide a bias voltage $V_{g1}$ to MOSFET device $M_{Z1}$. The biasing circuit comprises a p-channel MOSFET device $M_{Z1D}$, and a current source $I_1$. The source connection of MOSFET device $M_{Z1}$ is connected to the supply voltage, and the drain connection of MOSFET device $M_{Z1}$ is connected to the capacitive element $C_C$. The capacitive element $C_C$ also connects to the gate connection of MOSFET $M_{15}$. The source connection of MOSFET device $M_{Z1D}$ connects to the supply voltage, and MOSFET device $M_{Z1D}$ is connected to operate as a diode (i.e., the gate connection is connected to the drain connection). Current source $I_1$ connects between the drain connection of MOSFET device $M_{Z1D}$ and a ground node to produce the bias voltage $V_{g1}$ at the gate and drain connections of MOSFET device $M_{Z1D}$. The bias voltage $V_{g1}$ is provided to the gate connection of MOSFET device $M_{Z1}$.

The second portion of frequency compensation circuit 304 comprises a p-channel MOSFET device $M_{Z2}$ and a biasing circuit configured to provide a bias voltage $V_{g2}$ to MOSFET device $M_{Z2}$. The biasing circuit comprises a p-channel MOSFET device $M_{Z2D}$, two relatively large p-channel MOSFET devices $M_{big1}$ and $M_{big2}$, a current source $I_L/m$, a current source $V_{reg}/nR$, and a resistive element R. The source connection of MOSFET device $M_{Z2}$ is connected to the supply voltage and the drain connection of MOSFET device $M_{Z2}$ is connected to capacitive element $C_C$. The source connection of MOSFET device $M_{Z2D}$ connects to the supply voltage. The drain connection of MOSFET device $M_{Z2D}$ connects to the source connection of MOSFET device $M_{big1}$. MOSFET device $M_{big1}$ is connected to operate as a diode (i.e., the gate connection is connected to the drain connection). The source connection of MOSFET device $M_{big2}$ connects to the supply voltage, and the drain connection of MOSFET device $M_{big2}$ connects to a first end of resistive element R. MOSFET device $M_{big2}$ is connected to operate as a diode (i.e., the gate connection is connected to the drain connection). Current source $V_{reg}/nR$ connects to a second end of resistive element R to produce a gate voltage $V_{g3}$ at the gate connection of MOSFET device $M_{Z2D}$. The derivation of current source $V_{reg}/nR$ according to one embodiment is described below with reference to FIG. 5. Current source $I_L/m$ connects between the gate and drain connections of MOSFET device $M_{big1}$ and a ground node to produce bias voltage $V_{g2}$ at the gate and drain connections of MOSFET device $M_{big1}$. The derivation of current source $I_L/m$ according to one embodiment is described below with reference to FIG. 4. The bias voltage $V_{g2}$ is provided to the gate connection of MOSFET device $M_{Z2}$.

Because MOSFET devices $M_{big1}$ and $M_{big2}$ are relatively large devices, the source-to-gate voltage of each device approaches the threshold voltage $V_{TP}$.

As will now be described, frequency compensation circuit 304 operates to cause the conductance of MOSFET device $M_{Z1}$ to track the transconductance of MOSFET device $M_{14}$ ($g_{M14}$) and to cause the conductance of MOSFET device $M_{Z2}$ to track the conductance of the load ($g_L$). By doing so, frequency compensation circuit 304 ensures that the regulated voltage $V_{reg}$ provided by feedback circuit 302 remains constant over a relatively wide range of load current $I_L$.

By breaking the feedback loop and applying an initial voltage at the gate of MOSFET device $M_{15}$, the loop gain equation of voltage regulator 122 may be derived to identify the dominant pole, the non-dominant pole, the DC gain, and the zero of voltage regulator 122 as shown in Equations I–IV, respectively. In the equations below, $R_Z$ represents the combined resistance across the MOSFET devices $M_{Z1}$ and $M_{Z2}$.

$$DOMINANTPOLE = \frac{1}{2\pi R_{M12} C_C} \quad \text{Equation I}$$

$$NON\text{-}DOMINANTPOLE = \frac{g_{M14} + g_L}{C_L} \quad \text{Equation II}$$

$$DCGAIN = \frac{g_{M15} g_{M14} R_{M12}}{g_{M14} + g_L} \quad \text{Equation III}$$

$$\text{ZERO} = \frac{1}{R_Z C_C} \quad \text{Equation IV}$$

To enhance the phase margin and gain margins of voltage regulator 122, the zero may be set equal to the non-dominant pole as shown in Equation V.

$$\frac{1}{R_Z C_C} = \frac{g_{M14} + g_L}{C_L} \quad \text{Equation V}$$

Equation V may be solved for the combined conductance of MOSFET devices $M_{Z1}$ and $M_{Z2}$ ($g_Z$) to derive Equation VI.

$$g_Z = \frac{C_C}{C_L}(g_{M14} + g_L) \quad \text{Equation VI}$$

Equation VII may be derived from Equation VI by assuming that $C_C = C_L$.

$$g_Z = g_{M14} + g_L \quad \text{Equation VII}$$

From Equation VII, the conductance of MOSFET device $M_{Z1}$ ($g_{Z1}$) is configured to track the transconductance of $M_{14}$ ($g_{M14}$). In voltage regulator 122, the current through MOSFET device $M_{12}$, the current through MOSFET device $M_{O4}$, and the current $I_1$ are based on the same master reference bias current ($I_b$) and all track each other. Accordingly, Equations VIII through X may be derived.

$$I_{12} = I_{13} \propto I_b \quad \text{Equation VIII}$$

$$I_{13} + I_{14} = I_{O4} \propto I_b \quad \text{Equation IX}$$

$$I_{15} = I_{14} + I_L \quad \text{Equation X}$$

Because the above currents are based on the same master reference bias current $I_b$ and all track each other, the currents $I_{M14}$ and $I_1$ are set up to track each other. The transconductance of MOSFET device $M_{14}$ in the saturation region of operation and the conductance of the load in the saturation region of operation are shown in Equations XI and XII, respectively.

$$g_{M14} = \sqrt{2 I_{14} \mu_p C_{OX} \left(\frac{W}{L}\right)_{M_{14}}} \quad \text{Equation XI}$$

$$g_L = \frac{I_L}{V_{reg}} \quad \text{Equation XII}$$

Because the currents $I_1$ and $I_{M14}$ track each other, the transconductance of MOSFET device $M_{Z1D}$ tracks the transconductance of MOSFET device $M_{14}$. Accordingly, the conductance of MOSFET device $M_{Z1}$ in the linear region is set equal to the transconductance of MOSFET device $M_{Z1D}$ in the saturation region of operation as indicated in Equation XIII where $\mu_p$ is the average carrier mobility of MOSFET device $M_{Z1D}$, $C_{OX}$ is the gate oxide capacitance of MOSFET device $M_{Z1D}$, W is the channel width of MOSFET device $M_{Z1D}$, and L is the channel length of MOSFET device $M_{Z1D}$. In addition, MOSFET device $M_{Z1D}$ sets up the gate voltage $V_{g1}$ to cause MOSFET device $M_{Z1}$ to be operated in its linear region.

$$g_{Z1} = g_{Z1D} = \sqrt{2 I_1 \mu_p C_{OX} \left(\frac{W}{L}\right)_{M_{Z1D}}} = g_{M14} \quad \text{Equation XIII}$$

By setting the conductance of MOSFET device $M_{Z1}$ equal to the transconductance of MOSFET device $M_{Z1D}$ in the saturation region of operation, the conductance of MOSFET device $M_{Z1}$ tracks the transconductance of MOSFET device $M_{14}$.

Referring back to Equation VII, the conductance of MOSFET device $M_{Z2}$ ($g_{Z2}$) is configured to track the conductance of the load of functional unit 124 ($g_L$). The conductance of MOSFET device $M_{Z2}$ in the linear region of operation is expressed in Equation XIV where $\mu_p$ is the average carrier mobility of MOSFET device $M_{Z2}$, $C_{OX}$ is the gate oxide capacitance of MOSFET device $M_{Z2}$, W is the channel width of MOSFET device $M_{Z2}$, and L is the channel length of MOSFET device $M_{Z2}$. MOSFET device $M_{Z2}$ is selected such that its size is $$m\left(\frac{W}{L}\right),$$

and MOSFET device $M_{Z2D}$ is selected such that its size is $$n\left(\frac{W}{L}\right). \quad \text{Equation XIV}$$

$$g_{Z2} = m \mu_p C_{OX} \left(\frac{W}{L}\right)(V_{dd} - V_{g2} - |V_{TP}|)$$

Because MOSFET devices $M_{big1}$ and $M_{big2}$ are relatively large devices, the source-to-gate voltage of each device approaches the threshold voltage $V_{TP}$ which allows Equations XV and XVI to be derived.

$$V_{g2} = V_{dd} - |V_{TP}| - \left(\left(\frac{I_L}{m}\right) R_{MZ2D}\right) \quad \text{Equation XV}$$

$$R_{MZ2D} = \frac{1}{n \mu_p C_{OX} \left(\frac{W}{L}\right)\left(V_{dd} - |V_{TP}| - \left(V_{dd} - |V_{TP}| - \frac{V_{reg}}{n}\right)\right)} = \frac{1}{g_{MZ2D}} \quad \text{Equation XVI}$$

By substituting Equations XV and XVI into Equation XIV and reducing terms, Equation XVII is derived.

$$g_{Z2} = \frac{I_L}{V_{reg}} = g_L \quad \text{Equation XVII}$$

Accordingly, the conductance of MOSFET device $M_{Z2}$ tracks the conductance of the load $g_L$ of functional unit 124. MOSFET device $M_{Z2D}$ is biased in its linear region of operation to cause it to behave like a resistor whose value is given by Equation XVI. To ensure that MOSFET device $M_{Z2D}$ is biased in its linear region of operation, MOSFET device $M_{Z2D}$ is operated such that the condition in Equation XVIII holds true.

$$\left(\frac{I_L}{m}\right)R_{MZ2D} \ll V_{dd} - V_{g3} - |V_{TP}| \quad \text{Equation XVIII}$$

By solving for $I_L$, Equation XVIII may be reduced to Equation XIX.

$$I_L \ll m(V_{reg})^2\left(\mu p C_{OX}\left(\frac{W}{L}\right)\right) \quad \text{Equation XIX}$$

Accordingly, MOSFET device $M_{Z2D}$ is biased in its linear region of operation as long as the maximum value of the load current remains substantially below the value calculated on the right side of Equation XIX. The maximum value of the load current may remain substantially below the value calculated on the right side of Equation XIX by selecting appropriate values of W, L, and m for MOSFET device $M_{Z2D}$.

By selecting appropriate MOSFET devices for devices $M_{Z1}$, $M_{Z1D}$, $M_{Z2}$, and $M_{Z2D}$ in the zero circuit, as described above, Equation XX holds true and the zero of voltage regulator 122 tracks the non-dominant pole over process, temperature, supply voltage, and load current variations. Accordingly, voltage regulator 122 may be stabilized over relatively wide variations of load current for functional unit 124.

$$g_Z = g_{Z1} + g_{Z2} = g_{M14} + g_L \quad \text{Equation XX}$$

Figure 4:
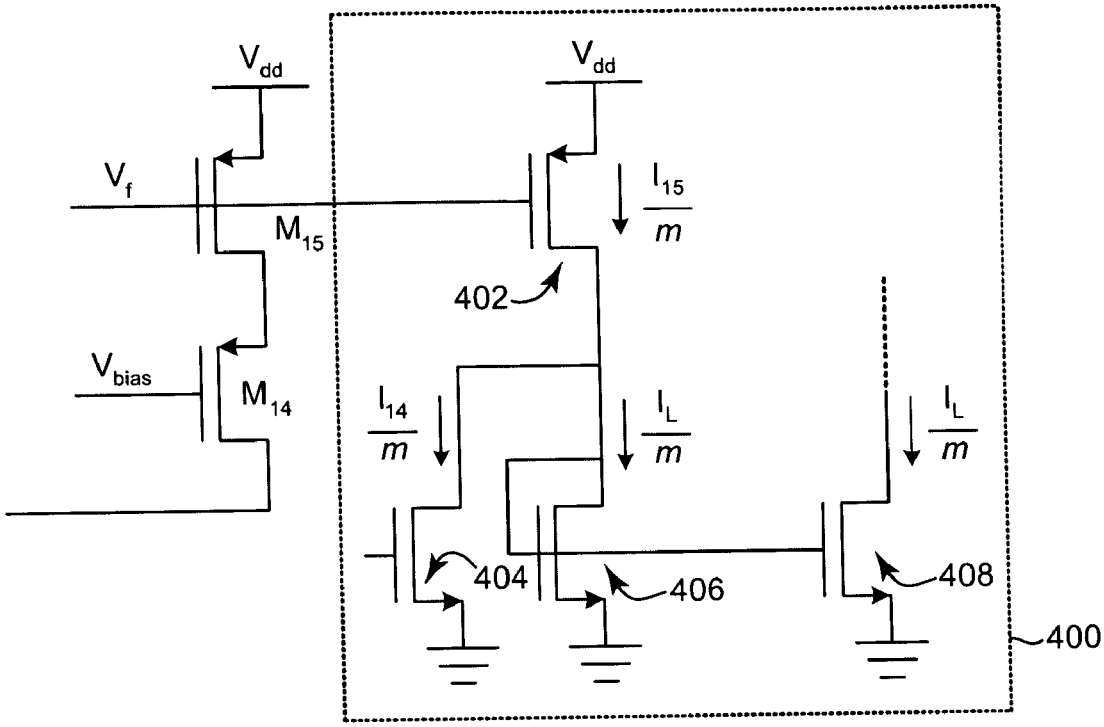
FIG. 4 is a circuit diagram illustrating an embodiment of a portion of the voltage regulator shown in FIG. 3.

FIG. 4 illustrates an embodiment of a circuit 400 used to generate current source $I_L/m$ in voltage regulator 122. In the embodiment of FIG. 4, current source $I_L/m$ is derived by mirroring the current of MOSFET device $M_{15}$. More particularly, the feedback voltage $V_f$ is provided to the gate connection of a p-channel MOSFET device 402. The source connection of MOSFET device 402 is connected to the supply voltage and the drain connection of MOSFET device 402 is connected to the drain connections of n-channel MOSFET devices 404 and 406. The drain and gate connections of MOSFET device 406 are connected to operate MOSFET device 406 as a diode, and the gate connection of MOSFET device 406 is connected to the gate connection of a MOSFET device 408. The drain connection of MOSFET device 408 is connected to the gate and drain connections of MOSFET device Mbig1 (shown in FIG. 3). The source connections of MOSFET devices 404, 406, and 408 are connected to a ground node.

MOSFET device 402 is selected such that it mirrors the value of current flow through MOSFET device $M_{15}$ divided by a factor m. As a result, the current flow through MOSFET device 402 is $I_{15}/m$, and the current flows through MOSFET devices 404, 406, and 408 are $I_{14}/m$, $I_L/m$, and $I_L/m$, respectively. Accordingly, the circuit 400 generates the current source $I_L/m$. In one embodiment, m may be selected to be a value of 32. In other embodiments, m may be selected to be other suitable values.

Figure 5:
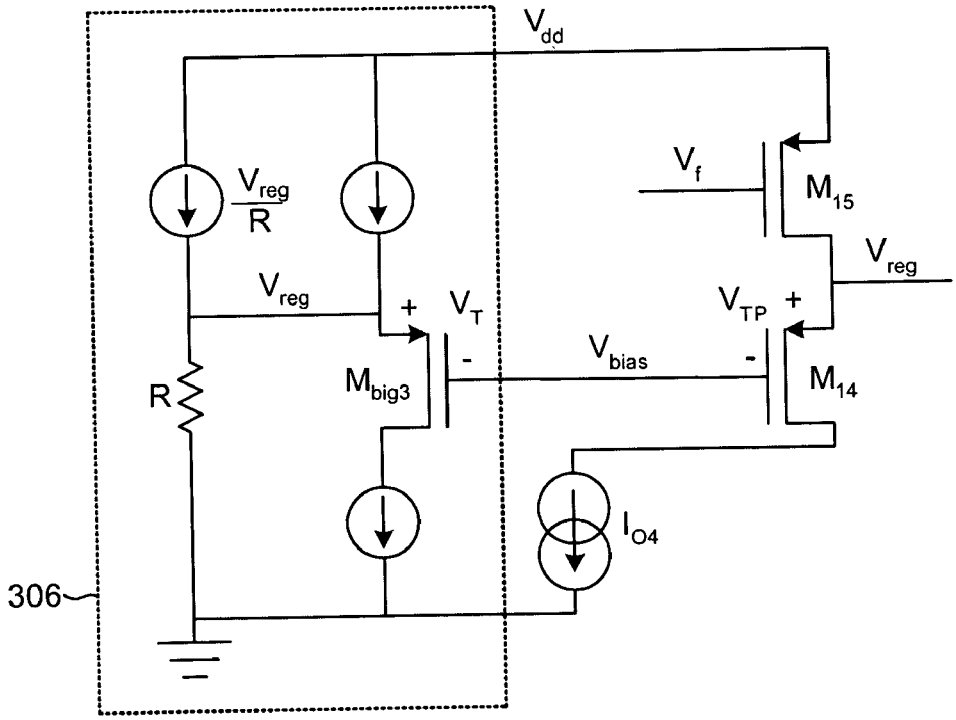
FIG. 5 is a circuit diagram illustrating an embodiment of a portion of the voltage regulator shown in FIG. 3.

FIG. 5 is a circuit diagram illustrating an embodiment of bias circuit 306 as shown in FIG. 3. Bias circuit 306 comprises a master calibrated current source $V_{reg}/R$, a resistive element R, a p-channel MOSFET device $M_{big3}$, and current sources connected to the drain and source connections of MOSFET device $M_{big3}$. MOSFET device $M_{big3}$ is a relatively large device such that the source to gate voltage approaches the threshold voltage $V_T$. Accordingly, the bias voltage $V_{bias}$ at the gate of MOSFET device $M_{14}$ is equal to the regulated voltage $V_{reg}$ (i.e., $R*(V_{reg}/R)$) minus the threshold voltage $V_T$.

Referring back to FIG. 3, the current source $V_{reg}/nR$ may be derived using the master calibrated current source $V_{reg}/R$ and a current mirror circuit (not shown) which includes MOSFET devices selected such that the resulting current is $V_{reg}/nR$.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A voltage regulator configured to provide a regulated voltage to a load having a first conductance, the voltage regulator comprising:

a feedback circuit configured to generate the regulated voltage; and a frequency compensation circuit comprising a first MOSFET device having a second conductance;

wherein the frequency compensation circuit is configured to operate the first MOSFET device so that the second conductance varies in response to the first conductance of the load, wherein the feedback circuit comprises a second MOSFET device having a transconductance, wherein the frequency compensation circuit comprises a third MOSFET device having a third conductance, wherein the frequency compensation circuit is configured to operate the third MOSFET device so that the third conductance varies in response to the transconductance of the second MOSFET device, wherein the frequency compensation circuit comprises a first bias circuit and a second bias circuit, wherein the first bias circuit is configured to provide a first voltage to the third MOSFET device to cause the third conductance to vary in response to the transconductance of the second MOSFET device, wherein the second bias circuit is configured to provide a second voltage to the first MOSFET device to cause the second conductance to vary in response to the first conductance, wherein the first bias circuit comprises a fourth MOSFET device having a gate connection and a drain connection and a first current source connected to the gate connection, the drain connection, and a ground node, and wherein the first current source is configured to draw a first current from the fourth MOSFET device to generate the first voltage.

2. The voltage regulator of claim 1 wherein the second bias circuit comprises a fifth MOSFET device, a sixth MOSFET device, a seventh MOSFET device, a second current source, a third current source, and a resistive element having a first end and a second end, wherein the second current source is configured to draw a second current from the fifth MOSFET device through the resistor to generate a third voltage which is provided to the sixth MOSFET device, and wherein the third current source is configured to draw a third current from the sixth MOSFET device and the sixth seventh device to generate the second voltage.

3. The voltage regulator of claim 2 wherein the second current source is proportional to a master generated current source.

4. The voltage regulator of claim 2 wherein the third current source is proportional to a fourth current drawn by the load.

5. The voltage regulator of claim 1 wherein the feedback circuit further comprises a third bias circuit configured to provide a bias voltage to the second MOSFET device to control a feedback current though the second MOSFET device.

6. The voltage regulator of claim 1 wherein the feedback circuit further comprises a fifth MOSFET device, and wherein the fifth MOSFET device is configured to provide a load current to the load and the feedback current to the second MOSFET device.

7. The voltage regulator of claim 6 wherein the frequency compensation circuit further comprises a capacitive element having a first end connected to the fifth MOSFET device and a second end connected to the first MOSFET device and the third MOSFET device.

8. A system comprising:

a functional unit having a first conductance; and a voltage regulator comprising:

a first circuit configured to provide a regulated voltage to the functional unit; and a second circuit comprising a first MOSFET device having a second conductance;

wherein the second circuit is configured to operate the first MOSFET device so that the second conductance tracks the first conductance of the functional unit, wherein the first circuit comprises a second MOSFET device having a transconductance, wherein the second circuit comprises a third MOSFET device having a third conductance, wherein the second circuit is configured to operate the third MOSFET device so that the third conductance varies in response to the transconductance of the second MOSFET device, wherein the second circuit comprises a first bias circuit and a second bias circuit, wherein the first bias circuit is configured to provide a first voltage to the third MOSFET device to cause the third conductance to vary in response to the transconductance of the second MOSFET device, wherein the second bias circuit is configured to provide a second voltage to the first MOSFET device to cause the second conductance to vary in response to the first conductance, wherein the first bias circuit comprises a fourth MOSFET device having a gate connection and a drain connection and a first current source connected to the gate connection, the drain connection, and a ground node, and wherein the first current source is configured to draw a first current from the fourth MOSFET device to generate the first voltage.

9. The system of claim 8 further comprising:

a transceiver that comprises the functional unit.

10. The system of claim 9 wherein the transceiver is configured for use in a Global System for Mobile Communications (GSM) network.

11. The system of claim 8 wherein the second circuit is configured to operate the first MOSFET device in a linear region of the first MOSFET device.

12. The system of claim 8 wherein the second circuit comprises a second current source configured to generate a second current that is proportional to a third current provided to the functional unit, and wherein the second circuit is configured to generate the second voltage using the second current.

13. The system of claim 12 wherein the second circuit comprises a third current source configured to generate a fourth current that is proportional to a fifth current generated by a master calibrated current source, and wherein the second circuit is configured to generate the second voltage responsive to the fourth current.

14. The system of claim 8 wherein the first conductance varies over time.

15. A voltage regulator configured to provide a regulated voltage to a load having a first conductance, the voltage regulator comprising:

a feedback circuit configured to generate the regulated voltage; and a frequency compensation circuit comprising a first MOSFET device having a second conductance;

wherein the frequency compensation circuit is configured to operate the first MOSFET device so that the second conductance varies in response to the first conductance of the load, wherein the feedback circuit comprises a second MOSFET device having a transconductance, wherein the frequency compensation circuit comprises a third MOSFET device having a third conductance, wherein the frequency compensation circuit is configured to operate the third MOSFET device so that the third conductance varies in response to the transconductance of the second MOSFET device, wherein the frequency compensation circuit comprises a first bias circuit and a second bias circuit, wherein the first bias circuit is configured to provide a first voltage to the third MOSFET device to cause the third conductance to vary in response to the transconductance of the second MOSFET device, wherein the second bias circuit is configured to provide a second voltage to the first MOSFET device to cause the second conductance to vary in response to the first conductance, wherein the second bias circuit comprises a fourth MOSFET device, a fifth MOSFET device, a sixth MOSFET device, a first current source, a second current source, and a resistive element having a first end and a second end, wherein the first current source is configured to draw a first current from the fourth MOSFET device through the resistor to generate a third voltage which is provided to the fifth MOSFET device, and wherein the second current source is configured to draw a second current from the fifth MOSFET device and the sixth MOSFET device to generate the second voltage.

16. The voltage regulator of claim 15 wherein the first bias circuit comprises a seventh MOSFET device having a gate connection and a drain connection and a third current source connected to the gate connection, the drain connection, and a ground node, and wherein third the current source is configured to draw a third current from the seventh MOSFET device to generate the first voltage.

17. The voltage regulator of claim 15 wherein the first current source is proportional to a master generated current source.

18. The voltage regulator of claim 15 wherein the second current source is proportional to a third current drawn by the load.

19. The voltage regulator of claim 15 wherein the feedback circuit further comprises a third bias circuit configured to provide a bias voltage to the second MOSFET device to control a feedback current though the second MOSFET device.

20. The voltage regulator of claim 15 wherein the feedback circuit further comprises a seventh MOSFET device, and wherein the seventh MOSFET device is configured to provide a load current to the load and the feedback current to the second MOSFET device.

* * * * *